United States Patent [19]

Davis et al.

[11] 4,053,426

[45] Oct. 11, 1977

[54] LUBRICANT COMPOSITIONS

[75] Inventors: Robert H. Davis, Pitman; John W. Schick, Cherry Hill, both of N.J.

[73] Assignee: Mobil Oil Corporation, New York, N.Y.

[21] Appl. No.: 558,879

[22] Filed: Mar. 17, 1975

[51] Int. Cl.[2] ..... C10M 1/32

[52] U.S. Cl. ..... 252/34; 72/42; 252/34.7; 252/49.3; 252/51.5 A; 252/392; 560/155

[58] Field of Search ..... 252/34, 49.3, 34.7, 252/392, 51.5 A; 72/42; 260/485 J, 485 G

[56] References Cited

U.S. PATENT DOCUMENTS

| | | | |
|---|---|---|---|
| 2,689,828 | 9/1954 | Smith et al. | 252/34 |
| 2,830,021 | 4/1958 | Smith et al. | 252/34 |
| 3,184,474 | 5/1965 | Catto et al. | 252/51.5 A |
| 3,219,666 | 11/1965 | Norman et al. | 260/485 J |
| 3,381,022 | 4/1968 | Le Suer | 260/485 J |
| 3,448,049 | 6/1969 | Preuss et al. | 260/485 J |
| 3,839,419 | 10/1974 | Samour et al. | 260/485 J |

FOREIGN PATENT DOCUMENTS

| | | | |
|---|---|---|---|
| 744,377 | 10/1966 | Canada | 252/51.5 A |

*Primary Examiner*—C. Davis

*Attorney, Agent, or Firm*—Charles A. Huggett; Thomas S. Szatkowski

[57] ABSTRACT

Lubricant compositions are provided containing from about 0.5 to about 65%, by weight, of an amine salt of a partial ester of an alkyl or alkenyl succinic acid. These amine salts are effective as biocidal and anti-rust agents.

3 Claims, No Drawings

LUBRICANT COMPOSITIONS

BACKGROUND OF THE INVENTION

1. Field of the Invention

This invention relates to improved lubricant compositions and, in one of its aspects, relates more particularly to lubricant compositions which exhibit improved anti-rust and biocidal properties and also non-ferrous metal deactivation properties. Still more particularly, in this aspect, the invention relates to lubricant compositions in the form of liquid hydrocarbons, greases, synthetic lubricants or water-base metalworking fluids which are normally subject to one or more of the aforementioned characteristics of biocidal effects and metal deterioration properties.

2. Description of the Prior Art

It is well known that certain types of lubricants, are subject to microbial degradation and other forms of metal deterioration in the course of performing their intended functions.

These shortcomings of such lubricants clearly suggest the necessity for incorporating therein effective, biocidal agents and metal deterioration preventing agents to offset the aforementioned undesirable characteristics.

SUMMARY OF THE INVENTION

It has now been found that the aforementioned biocidal properties, together with concommitant metal deterioration can be effectively improved by incorporating in the lubricant composition, an amine salt of a partial alkyl ester of an alkyl or alkenyl succinic acid. For most applications these amine salts are employed in an amount from about 0.5 to about 65% by weight, and preferably in an amount from about 5 to about 50%, by weight, of the total lubricant composition.

Where the lubricant comprises an oil of lubricating viscosity, the lubricant may comprise any mineral or synthetic oil of lubricating viscosity. In instances where high temperature stability is not a prime requirement, mineral oils at a viscosity of at least 40 SSU at 100° F. and particularly those falling within the range from about 60 SSU to about 6000 SSU at 100° F. are preferably employed. In instances where the lubricant comprises a synthetic hydrocarbon oil rather than a mineral oil, or in combination therewith, various compounds of this type may be successfully utilized. Typical synthetic vehicles include: polypropylene glycol, trimethylol propane esters, neopentyl and pentaerythritol esters, di-(2-ethyl hexyl) sebacate, di-(2-ethyl hexyl) adipate, dibutyl phthalate, fluorocarbons, silicate esters, silanes, esters of phosphorous-containing acids, liquid ureas, ferrocene derivatives, hydrogenated mineral oils, chain-type polyphenyls, silixanes and silicones (polysiloxanes), alkyl-substituted diphenyl ethers typified by a butyl-substituted bis(p-phenoxy phenyl) ether, phenoxy phenyl ethers, etc.

The aforementioned liquid hydrocarbon or synthetic lubricants may also be employed in combination with a grease forming quantity of a thickening agent as vehicles in the production of greases containing the above-described amine salts. For this purpose, a wide variety of materials may be employed. These thickening or gelling agents may include any of the conventional metal salts or soaps, which are dispersed in the lubricating vehicle in grease-forming quantities, in such degree as to impart to the resulting grease composition, the desired consistency. Other thickening agents that may be employed in the grease formation may comprise the nonsoap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon or synthetic fluids for forming grease can be used in preparing the aforementioned improved grease in accordance with the present invention. The amine salts of the present invention may also be effectively incorporated into water-base and metal-working fluids for their beneficial effect. It is contemplated that any alkyl, aromatic or alkanolamine having 2 to 22 carbon atoms may be employed for forming the salt of the aforementioned partial ester of an alkyl or alkenyl succinic acid. In a preferred modification, alkanolamines are most advantageously employed and may suitably range in chain length from about 2 to about 6 carbon atoms. Preferably, these amines should be liquid at room temperature. The lower molecular weight amines are generally preferred and for this purpose, it has been found that such alkanolamines as mono-, or tri-ethanolamine are highly effective. The amines may be water-soluble or oil-soluble and may, therefore, include such alkanolamines as iso-propanolamines, e.g., mono-, di- and tri-isopropanolamine, di-methylethanolamine , diethylethanolamine, aminoethylethanolamine, N-acetyl ethanolamine, phenylethanolamine, phenyldiethanolamine and mixtures thereof.

Any alkyl or alkenyl succinic acid, the alkyl or alkenyl substituent of which contains from about 6 to about 22 carbon atoms may be employed for forming the partial ester, which is reacted with the amine. Typically representative of such alkyl or alkenyl succinic acids, are tetrapropenyl-succinic, octenylsuccinic, dodecenylsuccinic, polybutenylsuccinic, hexadecenylsuccinic, triacontenylsuccinic and isooctadecylsuccinic acids. The alcohol utilized in forming the partial esters of these acids include alcohols having from 1 to 18 carbon atoms such as methanol, ethanol, propanol, butanol and the like.

DESCRIPTION OF SPECIFIC EMBODIMENTS

Conventional water-base metalworking fluids are formulated by combining as many as nine components in order to function effectively in a wide range of operations with minimum adverse side-effects such as rust, hard water stability and foam. In accordance with the present invention the amine salts of partial esters of akyl or alkenyl succinic acids, can be used to replace a number of these additives. Thus, as shown in the following Table I the data therein indicates that the amine salt reaction products are effective as biocide, anti-rust and non-ferrous metal deactivating agents.

The biocidal activity test is conducted as follows:

In this procedure ½ inch × ½inch × 0.027 inch thick filter paper is saturated with the biocidal test solution (approximately ½ ml.). This square is placed in the center of a nutrient agar plate previously innoculated with bacteria (predominantly pseudomonas). In this test an effective biocidal agent should inhibit growth adjacent to the filter paper. The distance from the edge of the paper to the point where bacterial growth begins, is indicative of activity. The data recorded in the tables with respect to reactant and water components is in percent, by weight.

In Example 1 the filter paper was saturated with a 45% triethanolamine solution. Little or no bacterial inhibition resulted after 120 hours i.e., heavy bacterial growth was observed 1/16 inch from the test paper. However, the same test performed on a triethanolamine/tetrapropenylsuccinic acid/partial ester adduct (Example 2) resulted in 6/16 inch growth inhibition, thus indicating an unexpected degree of biocidal activity.

The formulation of Example 2 also provides an unexpected degree of rust protection for malleable iron and prevention of staining of non-ferrous metals, such as aluminum. The malleable iron rust test is conducted as follows.

Malleable iron chips are placed in a 50 ml container together with the fluid composition which is to be evaluated. All excess liquid is then drained off, and the chips are stored in an atmosphere of aproximately 90 percent relative humidity and at a temperature between about 70° and 75° F. The sample is checked, after a period of 48 hour storage, for appearance of rust.

The aluminum stain test is conducted as follows.

The aluminum stain test employed comprised placing approximately ½ oz. of the lubricant solution to be evaluated in a 2 oz. jar, together with a 2¼ inch rod of aluminum previously cleaned with a medium grade of emery cloth. Approximately ½ of this rod was immersed below the surface of the test solution and the remaining portion exposed to air. Staining tendency was observed over a period of 48 hours.

In Table I the amine salt viz. the triethanolamine salt of tetrapropenyl succinic acid monomethyl ester, is formed in situ. The amine salt, may, also be performed before addition thereof to the base lubricant.

TABLE I

AQUEOUS COOLANT CONTAINING TRIETHANOLAMINE/TETRAPROPENEYLSUCCINIC ACID MONO-ESTER

| | Example 1 | Example 2 |
|---|---|---|
| Formulation, % Weight | | |
| Triethanolamine | 45.00 | 30.00 |
| Tetrapropenylsuccinic acid/monomethyl ester | — | 15.00 |
| Water | 55.00 | 55.00 |
| Biocide Activity Test | | |
| Bacterial Growth Inhibition: Inches from Test Square | 1/16 | 6/16 |
| Malleable Iron Rust Test | | |
| 20/1 Distilled Water, 48 hrs. | Rust | No rust |
| Aluminum Stain Test | | |
| 20/1 Hard Water, 350 ppm, 48 hrs. | Black Stain | No Stain |

From the foregoing table, it will be apparent that an amine salt of a partial alkyl ester of an alkenyl succinic acid is markedly effective as biocidal and rust prevention agents and also as a non-ferrous deactivating agent.

While this invention has been described with reference to preferred compositions and components therefor, it will be understood by those skilled in the art that departure from the preferred embodiments can be effectively made and are within the scope of the specification.

We claim:

1. A water-base metal working fluid consisting essentially of water and, as a biocidal and anti-rust agent, the triethanolamine salt of the monomethyl ester of an alkyl or akenyl succinic acid, the alkyl or alkenyl substituent of which contains from about 6 to about 22 carbon atoms.

2. The fluid of claim 1 wherein said ester is the monomethyl ester of tetrapropenylsuccinic acid.

3. The fluid of claim 1 wherein said water is present in an amount of 55%, by weight, and said salt is present in an amount of 45%, by weight, the triethanolamine component thereof being present in an amount of 30%, by weight, of the total composition and the monomethyl ester of tetrapropenylsuccinic acid component thereof being present in an amount of 15%, by weight, of the total composition.

* * * * *